US008820404B2

(12) United States Patent
Lisk

(10) Patent No.: US 8,820,404 B2
(45) Date of Patent: Sep. 2, 2014

(54) WATER WELL PUMPING AND CONTROL SYSTEM

(76) Inventor: Mike Lisk, Cloudcroft, NM (US)

( * ) Notice: Subject to any disclaimer, the term of this patent is extended or adjusted under 35 U.S.C. 154(b) by 431 days.

(21) Appl. No.: 13/167,328

(22) Filed: Jun. 23, 2011

(65) Prior Publication Data

US 2012/0325460 A1 Dec. 27, 2012

Related U.S. Application Data

(60) Provisional application No. 61/572,302, filed on Jun. 23, 2010.

(51) Int. Cl.

| | |
|---|---|
| ***E21B 47/00*** | (2012.01) |
| ***E21B 43/12*** | (2006.01) |
| ***F04D 15/00*** | (2006.01) |
| ***F04D 13/10*** | (2006.01) |
| ***F04D 15/02*** | (2006.01) |

(52) U.S. Cl.

CPC ..... *F04D 15/0209* (2013.01); *E21B 43/128* (2013.01); *F04D 15/0088* (2013.01); *F04D 13/10* (2013.01)

USPC ..... 166/250.03; 166/54; 166/250.01; 417/40

(58) Field of Classification Search

USPC ..... 166/250.01, 250.03, 53, 54, 68.5; 417/44.1, 44.2, 43, 40

See application file for complete search history.

(56) References Cited

U.S. PATENT DOCUMENTS

| | | | | |
|---|---|---|---|---|
| 1,035,431 A | | 8/1912 | Ericson | |
| 2,286,613 A | * | 6/1942 | Fuller | 137/211.5 |
| 3,937,599 A | | 2/1976 | Thureau et al. | |
| 3,963,374 A | | 6/1976 | Sullivan | |
| 4,180,374 A | * | 12/1979 | Bristow | 417/12 |
| 4,744,344 A | | 5/1988 | Morozumi | |
| 4,874,294 A | | 10/1989 | Karg | |
| 5,667,362 A | * | 9/1997 | Murai et al. | 417/41 |
| 5,718,269 A | * | 2/1998 | McGarvey | 141/198 |
| 6,382,225 B1 | * | 5/2002 | Tipton | 137/1 |
| 6,699,019 B2 | | 3/2004 | Myers et al. | |
| 2006/0112478 A1 | | 6/2006 | Kolar | |

FOREIGN PATENT DOCUMENTS

| | | |
|---|---|---|
| JP | 09189303 | 7/1997 |
| JP | 2001193140 | 7/2001 |
| JP | 2004108253 | 4/2004 |
| JP | 2010048020 | 3/2010 |
| KR | 2020100004835 | 5/2010 |
| WO | WO 01-21429 A1 | 3/2001 |

OTHER PUBLICATIONS

International Search Report and Written Opinion for PCT/US2012/054617 dated Mar. 8, 2013.

International Search Report and Written Opinion for PCT/US2011/041694 mailed Feb. 21, 2012.

* cited by examiner

*Primary Examiner* — Yong-Suk (Philip) Ro

(74) *Attorney, Agent, or Firm* — Womble Carlyle Sandridge & Rice, LLP

(57) ABSTRACT

A well watchman pumping and control system that is capable of operating in a wide range of ambient conditions. The system automatically maintains water level in a water storage vessel, while protecting the pump and generator from operating in conditions outside preset operating parameters to prevent premature failure and reduce repair. By operating to pump water only when preset operating conditions exist, e.g. low water level, ambient temperature, etc., the system reduces labor, fuel, and maintenance operating costs to the owner, improves well pumping reliability and production, reduces generator fuel consumption, reduces emissions, and conserves ground water.

22 Claims, 4 Drawing Sheets

WATER WELL PUMPING AND CONTROL SYSTEM

CROSS REFERENCE TO RELATED APPLICATION

The present application claims priority and benefit to U.S. Provisional Application No. 61/572,302, filed Jun. 23, 2010, which was originally filed as U.S. Nonprovisional patent application Ser. No. 12/822,077, on Jun. 23, 2010, but which was converted to a provisional application. The entirety of the disclosure, including specification and drawings, of the application filed on Jun. 23, 2010 as referenced above is specifically incorporated herein by reference as if set forth in its entirety.

BACKGROUND OF THE INVENTION

1. Field of the Invention

The present invention relates to a intelligent well watchman pumping and control system which monitors storage water levels typically at remote water wells such as livestock wells where utility power is not available, and then provides electrical power to a well pump on demand as it monitors and analyzes critical equipment safety conditions as well as maintenance and production parameters controlling the water pumping process automatically without the requirements of an on-site operator.

2. Description of the Invention

Water production on remote wells for livestock and other applications have long been problematic in the livestock industry with the typical low production rates of solar pumping systems on deep wells and failure rates along with the maintenance costs and access challenges of windmill water production. Many within the industry have resorted to point of use generators which require repeated trips to the remote well site to fuel and start the generator to pump the required water to satisfy livestock water consumption needs. Solar power has been seen as an effective answer to the challenge, but with solar powered water pumping systems, flow rates on deep water wells are typically very low when compared to the flow rates of a standard deep well pump supported by AC electrical power. Solar energy production is dependent on exposure to sunlight. Water production capabilities will be decreased or can cease in long times of decreased or no sunlight. In some cases, the water production rate of a solar water production system is the primary limiting factor restricting a livestock property to realize its full potential. In solar water production systems that do not utilize level control, water in excess of the amount that can be held by the onsite water storage vessel can spill out of the vessel and be wasted.

Windmill water production is also a common solution to water production issues on remote water well sites. Typically, windmills are very wasteful when producing water. Unless turned off by an operator, windmills pump as long as wind is present. Once the storage vessel is full, excess water generally spills out onto the ground wasting the water and the operating efforts of the windmill. Windmills also tend to be expensive and difficult to maintain, often involving risky and hazardous conditions to the technician performing maintenance.

The point of use generator, though the least expensive up front, can overall be very expensive approach to water production. A generator typically requires an operator making a trip to the site with a container of fuel, fueling the generator, and then starting it along with the deep well pump in the well. Typically, the operator does not wait the several hours that it takes the generator to consume the fuel, but leaves the site understanding that when the generator has consumed all of the fuel, it will stop running. Allowing the generator to run out of fuel under an electrical load in this manner is extremely hazardous to both the generator and the deep well pump, often shortening the operating life of each piece. This practice further can lead to expensive repairs or early replacements of either the generator or the well pump.

U.S. Pat. Nos. 4,744,334 and 1,632,188 and 6,699,019 describe methods and apparatus for the pumping and transfer of ground water to the surface for livestock consumption needs. The invention disclosed in U.S. Pat. No. 4,744,334 generally suffers from a limited water production capability as compared to the invention of the well watchman pumping and control systems water production capabilities. The windmill water pumping inventions disclosed in U.S. Pat. Nos. 1,632,188 and 6,699,019 suffer in areas of accessibility for maintenance operational dependability cost of repairs and water conservation when compared to the invention well watchman pumping and control system.

SUMMARY OF THE INVENTION

The present invention is directed to a well watchman pumping and control system, which comprises a propane or other, similar fuel combustion engine driven electric generator and a cast of field sensors to automatically produce an on-demand electrical power supply sufficient to support an in-ground well water pump for filling a water storage vessel to a predetermined level, while continuously monitoring the water level in the storage vessel with the field sensors monitoring critical operating and environmental conditions and analyzing the conditions to control system operation, to prevent hazards to both pump and generator. The present invention further includes the capability to provide an alert to provide, for example, maintenance or troubleshooting messages or system status. The alert or notification can be displayed on an LCD screen at the control panel, or can be relayed to a location remote from the system, such as a text message, e-mail or other notification sent to an operator. The present invention thus can prevent waste of ground water, reduce fuel consumption and emissions due to the repeated frequencies of trips to well sites and/or due to an unmanned generator, and increase water production as needed for livestock, benefitting both the natural environment and operating costs to the user.

It is therefore an object of this present invention to provide a well watchman pumping and control system which will significantly enhance of water production capabilities at remote well sites where utility power is not available.

It is another object of this present invention to provide a well watchman pumping and control system which will significantly enhance the reliability of water production at a remote well site.

It is a further object of this present invention to provide a well watchman pumping and control system which can conserve ground water resources, improve fuel efficiency, and reduce the undesirable emissions from vehicular traffic to a well site and from unmanned generators.

It is a still another object of this present invention to provide a well watchman pumping and control system which reduce or eliminate health and safety hazards associated with technicians performing maintenance tasks on a windmill water production system at remote locations.

It is a still another object of this present invention to provide a well watchman pumping and control system which can provide a long life, cheap and dependable water production system for remote well sites using a domestically produced, environmentally friendly fuel.

The present invention provides a well watchman pumping and control system that includes an electric generator, a system control, a water storage vessel, a well pump that provides water to the water storage vessel, and a monitoring device for monitoring a water level in the water storage vessel, a flow rate of the pump, and operating conditions of the generator. The monitoring device operates to relay the water level in the water storage vessel to the system control and starts the generator and the well pump when the water level reaches a preset low level. The system control monitors the generator and the well pump to protect against operation under low flow conditions or operation of the generator or pump during unsuitable operating parameters. If the system shuts down, a troubleshooting message indicating any reasons for shutdown is provided. The monitoring device can be a float switch or a water pressure switch. The system can further include a means for monitoring pump discharge flow.

The system can further include at least one of (1) means for monitoring a fuel level and means for displaying a low fuel message, (2) means for monitoring an oil level and means for displaying a low oil message, (3) means for monitoring ambient temperature and means for displaying a low ambient temperature message, (4) means for monitoring a typical fill time of the storage vessel by monitoring the water flow rate from the pump, the quantity of water required to raise the water level to the high level, or the time lapsed between start and stop of the pump, or (5) means for monitoring electrical output from the generator. The system control ceases operation of the pump and generator at an occurrence of one of the following: (1) after the fuel level reaches a preset low fuel level, (2) after the oil level reaches a preset oil low level, (3) after the ambient temperature reaches a preset low ambient temperature, (4) after the typical fill time has lapsed without the monitoring device indicating the water level in the water vessel has reached the high level, or (5) after an indication that the electrical output from the generator is outside a preset electrical output range. The system control relays an error message at the occurrence of one of the following: (1) after the fuel level reaches a preset low fuel level, indicating the generator requires fuel, (2) after the oil level reaches a preset oil low level, indicating the generator requires oil (3) after the ambient temperature reaches a preset low ambient temperature, indicating the generator and pump should not be run (4) after the typical fill time has lapsed without the monitoring device indicating the water level in the water vessel has reached the high level, indicating a leak in the water storage vessel, or (5) after an indication that the electrical output from the generator is outside a preset electrical output range, indicating an electrical error.

The system control is capable of storing and transmitting at least one operating condition for display at the system, to at least one remote location, or both. The operating condition can include one or more of the following: water production data, run time of the generator or pump, lapsed time between operation of the generator or pump, aggregate amount of water pumped, or maintenance time to clean an air filter, oil, or spark plug of the generator. The operating condition can be displayed on an LCD screen at the system.

The present invention also includes a method of operating a well watchman pumping and control system, with the system including an electric generator, a system control, a water storage vessel, a well pump that provides water to the water storage vessel, and a monitoring device for monitoring a water level in the water storage vessel, a flow rate of the pump, and operating conditions of the generator. The method includes monitoring the water level in the water storage vessel with the monitoring device, and initiating operation of the generator and well pump when the water level reaches a preset low level. The monitoring can include the system control receiving a signal from the float switch or pressure switch to commence the system starting sequence. The system control generally initiates operation of the generator and the pump to pump water to fill the water storage vessel to a preset high level and then initiates a shutdown sequence of the generator and pump. The system then monitors operation of the pump. If the water flow is less than a preset flow rate, the method can further include stopping operation of the pump and generator by the system control. The method can further comprise relaying an error condition. The method can further include restarting the well waterman pumping and control system after a preset time has elapsed.

The method can further include at least one of the following: (1) monitoring a fuel level and displaying a low fuel message, (2) monitoring an oil level and displaying a low oil message, (3) monitoring ambient temperature and displaying a low ambient temperature message, (4) monitoring a typical fill time of the storage vessel by monitoring the water flow rate from the pump, the quantity of water required to raise the water level to the high level, or the time lapsed between start and stop of the pump, or (5) monitoring electrical output from the generator. The system control ceases operation of the pump and generator at an occurrence of one of the following: (1) after the fuel level reaches a preset low fuel level, (2) after the oil level reaches a preset oil low level, (3) after the ambient temperature reaches a preset low ambient temperature, (4) after the typical fill time has lapsed without the monitoring device indicating the water level in the water vessel has reached the high level, or (5) after an indication that the electrical output from the generator is outside a preset electrical output range.

The system control relays an error message at the occurrence of one of the following: (1) after the fuel level reaches a preset low fuel level, indicating the generator requires fuel, (2) after the oil level reaches a preset oil low level, indicating the generator requires oil (3) after the ambient temperature reaches a preset low ambient temperature, indicating the generator and pump should not be run (4) after the typical fill time has lapsed without the monitoring device indicating the water level in the water vessel has reached the high level, indicating a leak in the water storage vessel, or (5) after an indication that the electrical output from the generator is outside a preset electrical output range, indicating an electrical error.

These and various other objects of the present invention will become apparent to those skilled in this art upon reading the accompanying description, drawings, and claims set forth herein.

DETAILED DESCRIPTION OF THE INVENTION

Figure 1:
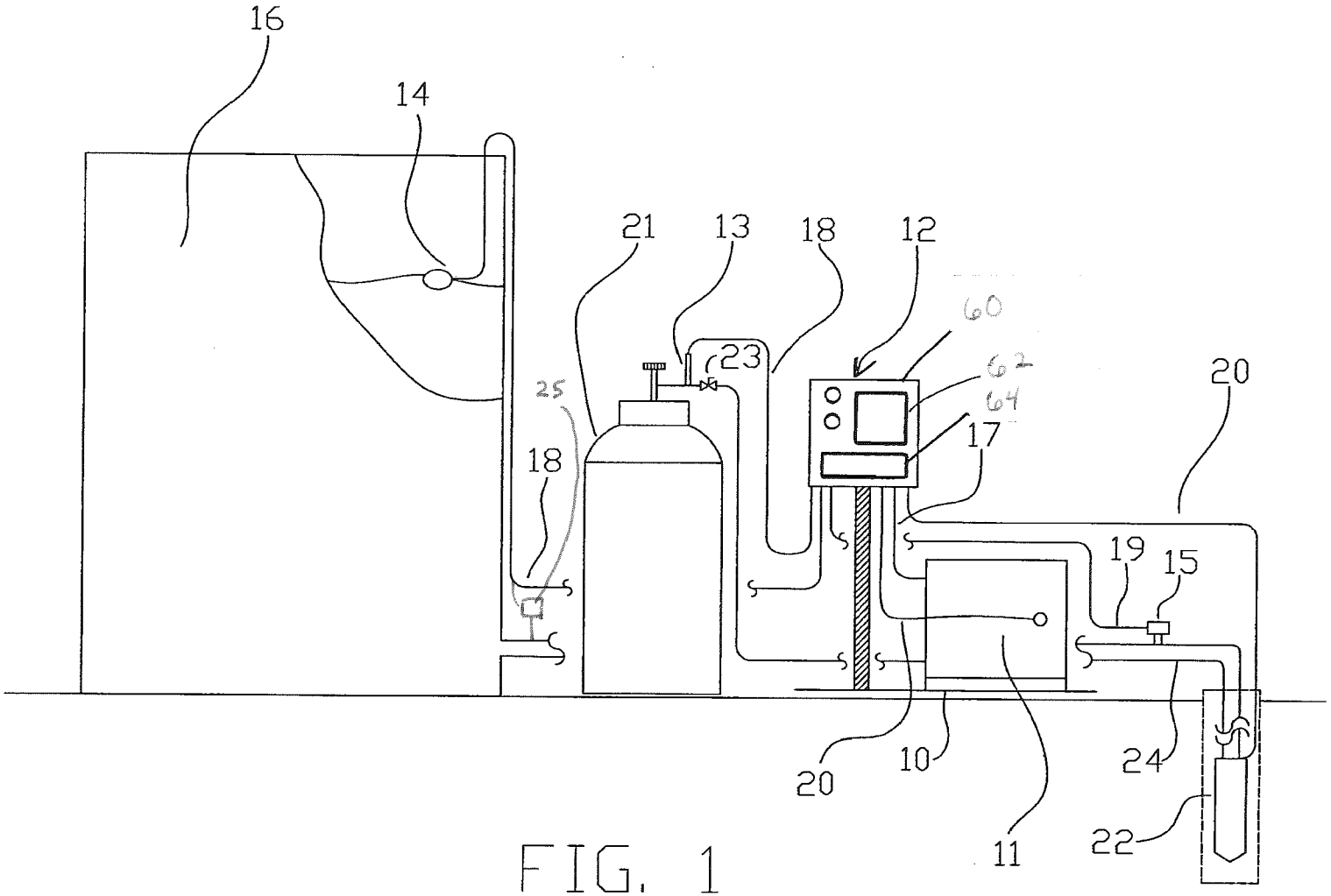
FIG. 1 is a front view schematically illustrating the well watchman pumping and control system according to the present invention.
Figure 2:
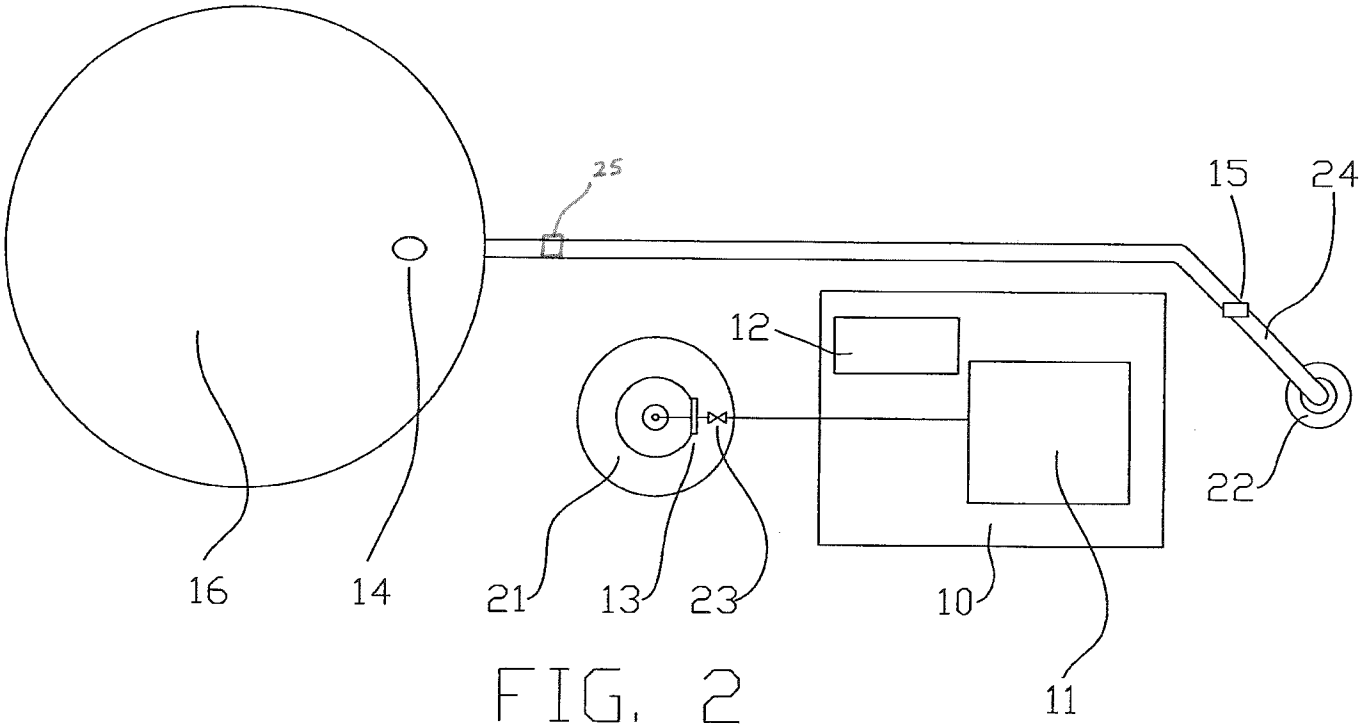
FIG. 2 is an overhead view of the well watchman pumping and control system.

A well watchman pumping and control system is the overall system detailed herein. FIG. 1 illustrates one embodiment of the well watchman pumping and control system according to the present invention. As seen in the drawings, the well watchman pumping and control system is a skid assembly 10 generally including an electric generator 11 driven by a propane or other fuel engine that will accommodate the electrical power requirements of a well pump 22, which is preferably a deep underground well pump. An example of such an electric generator is the EcoGen series generators available from GENERAC Power Systems of Waukesha, Wis. A system control panel 12 is electrically connected by a properly sized cord and plug assembly 20 for the required electrical load necessary to run the generator and pump. The system control panel preferably a NEMA 12, hinged door enclosure and inside the panel includes, a display 62 and user input 68, such as a keyboard, touch screen, etc., and a system control or processor 60 that enables outputs and receives and monitors inputs from a series of field devices including a float switch 14 or a water pressure switch 25, a fuel pressure switch 13, and a flow switch 15 as can be seen on FIG. 2 of the drawings. The float pressure and flow switches serve to monitor pumping control variables and system status conditions for an outdoor application at a water well site typically where utility power is not readily accessible, such as on remote and livestock water wells, reporting the system conditions to the system control panel, which in turn controls operation of the pump in response to such inputs to maintain the desired water level.

The float switch 14 is placed in the target water storage vessel 16 or a pressure switch 25 is placed into the water pipe 24 between the well discharge and the water storage vessel 16 to monitor for predetermined low and full water level conditions. The float switch 14 can be any high quality, durable float actuated, magnetic or mechanical micro switch rated for 12 volts DC or higher with a at least one set of normally open contacts, compatible with the ambient temperatures of the application. An example of a preferred water level float switch for this application would be a Dayton 3BY80 float switch. This switch is a durable switch compatible with the ambient temperatures of the application and is generally capable of greater than ten thousand cycles over its operating life, for example. The pressure switch 25 can be any type of durable liquid pressure sensing micro switch, with independent dual sets of normally open and normally closed contacts rated for 12 volts DC or higher. An example of a preferred water pressure switch for this application would be a PSW-852CL pressure switch from OMEGA Engineering of Stamford, Conn. The pressure switch 25 is a durable switch compatible with the ambient temperatures of the application. It has a field settable hysteresis and set point repeatability of +/−2% and a greater than ten thousand cycle rated operating life. The float switch 14, or the water pressure switch 25, is electrically connected by an electrical quick change cable and receptacle assembly 18. An example of a preferred assembly would be a Brad Harrison quick change cable and receptacle assembly model 112020A01F060 with a 1R2006A20A120 and a 1R2004A20A120.

When the float switch 14 or the water pressure switch 25, detects a low level condition in the water storage vessel 16, an electric signal will be sent from the switch to the well watchman pumping and control system control panel 12 where the low level signal is confirmed by the system control after a preset time to confirm the actual low level condition. The system control 12 operates on a pre-programmed sequence, an example of which follows. Once a low level condition in the storage vessel is confirmed, the control panel 12 will begin a system start up sequence with a start signal being sent to the skid mounted electric generator 10. The generator 10 will receive a start signal from the system control panel 12 starting the electric generator 11 producing electric power to support an electric motor on an underground deep well pump 22.

Once the generator 11 has started, the ON condition will be confirmed at the system control panel 12 receiving a signal of the output from the electric generator 11. Once the electric generator output is confirmed at the system control panel 12, a preset run time can be allowed to elapse allowing the engine of the electric generator 11 to warm up. After the preset warm up period is completed the system control panel 12 will turn on the electric power to the underground deep well pump 22, which can be any DC or sixty cycle AC electric motor driven submersible pump rated for the installation and compatible with the environmental conditions of the installation. The pump 22 is electrically connected to the system control panel by a cord and plug assembly 20, producing a water flow from the underground deep well pump 22 through a water pipe 24 to the water storage vessel 16, filling the water storage vessel 16 to a predetermined full level as signaled by the float switch 14 position of 45 degrees above horizontal position or the water pressure switch 25, pressure setting. When the water level in the water storage vessel 16 reaches a full condition as measured by the float switch 14 at a predetermined position or the water pressure switch 25 at a preset pressure setting, a signal will be sent from the float switch 14 or the water pressure switch 25, to the system control panel 12 to begin a controlled shutdown process of the underground deep well pump 22 and electric generator 11. The electrical supply to the well pump 22 will be turned OFF by the system control panel 12. The electric generator 11 will continue to run for a preset time to allow the electric generator 11 to warm down with no load and then it will shut off ready for the next fill cycle process to begin.

A flow switch 15 is located in the water pipe 24 between the well discharge and the water storage vessel 16. An example of a mechanical switch is a Dwyer F.S.-2 vane flow switch available from DWYER Instruments Inc. of Michigan City, Ind. and an example of a thermally actuated flow switch for this application would be a FST-211-SPST switch from OMEGA Engineering of Stamford, Conn. The flow switch 15 can be any temperature, magnetic or mechanically actuated micro switch rated for 12 volts DC or higher with a at least one set of normally closed contacts capable of sensing the lowest water flow level of the installation. The flow switch 15 is durable and compatible with the ambient temperatures of the application, can have a field adjustable set point, and generally is rated as a greater than ten thousand cycle operating life. The flow switch is electrically connected to the system control panel by an electrical quick change cable and receptacle assembly 19. An example of a preferred quick change cable and receptacle assembly would be a Brad Harrison model 113020A01F060 with a 1R3006A20A120 and a 1R3004A20A120. The flow switch 15 will confirm water flow within a preset time after the well pump is turned on. If no water flow is sensed or if water flow stops through the flow switch 15 for a preset time, then a signal will be sent from the flow switch 15 to the system control panel 12 to turn off the electrical power being supplied to the underground deep well pump 22 protecting it from operating in a no flow condition due to a frozen water pipe 24, a weak water supply in the well or any other condition that could prevent water from flowing when the underground deep well pump 22 is ON.

An alarm or other fault condition notification can be sent, for example, via text message or other indicator on the LCD screen 62 inside the system control panel 12 to indicate the no flow condition and can be automatically forwarded to a central control or operator, such as wirelessly, via e-mail, text, or other notification. After a preset time period has elapsed to allow a well to recharge with ground water seepage or to allow frozen water pipes 24 to thaw, the system control panel 12 will automatically initiate a new start up sequence still providing no flow pump protection by means of the flow switch 15. This sequence will repeat until the water storage vessel 16 has reached a full level as measured by the float switch 14 in the water storage vessel 16 or the water pressure switch 25 in the water pipe. A reset button inside the system control panel 12 thereafter can reset the text message and the well watchman pumping and control system 10, clearing the condition and allowing immediate operation but still monitoring any no flow condition reoccurrence.

To aid in the prevention of operating in a condition where a frozen water pipe may be present, a temperature sensor located inside of the system control panel 12 will prevent the start up of the system anytime that the temperature has dropped below a set temperature (e.g. thirty two degrees Fahrenheit (32° F.) or below) and will not allow the system the system to begin a startup sequence until the temperature sensed inside the control panel 12 has risen to a set temperature (e.g. forty degrees Fahrenheit (40° F.)) or the system reset button inside the system control panel 12 is initiated. A text message will be displayed of the condition on the LCD screen inside the system control panel 12 until the condition has cleared or the reset button inside the system control panel 12 has been initiated.

Fuel pressure is monitored by a pressure switch 13 with a Division 1 Hazardous rating with a least one set of normally closed contacts rated for 12 volts DC or higher with an adjustable set point range from eight to thirty pounds per square inch and at least a maximum working pressure rating of three hundred pounds per square inch and rated for outdoor installations. An example of a preferred pressure switch would be a PSW12T-AS switch available from Omega Engineering of Stamford, Conn. This pressure switch is electrically connected by an electrical quick change cable and receptacle assembly 13. An example of a preferred quick change cable and receptacle assembly would be a Brad Harrison model 112020A01F060 with a 1R2006A20A120 and a 1R2004A20A120 cable and receptacle assembly.

The fuel pressure switch 13 is located between the propane 21 tank, or other fuel supply, and the pressure regulator 23 supplying the electric generator 11. The fuel pressure switch 13 monitors the tank fuel level and senses a low fuel pressure condition, and will send a signal to the system control panel 12 to initiate a shutdown sequence when the fuel pressure drops to the set point of the pressure switch 13 while the system is running. Once a low fuel pressure level is sensed, a text message of the condition will be displayed on the LCD screen inside the system control panel 12 and the system will be prevented from restarting until the system is refueled to an adequate pressure above the pressure switch 13 set point and the system reset button inside the system control panel 12 is initiated, clearing the condition and the text message.

The well watchman pumping and control system 10 further can display on the LCD screen inside the system control panel 12 a series of maintenance text prompts, including air filter change after five hundred hours of operation, oil change after five hundred hours of operation, and/or spark plug change after five hundred hours of operation. All maintenance text prompts are based on operating hour interval times, recommended by the electric generator 11 manufacturer. Such prompts generally will be programmed into the system control inside of the system control panel 12, and a text message will be displayed at the end of each of these elapsed times to notify a technician/operator to perform the prompted task on the LCD screen inside of the system control panel 12. These maintenance text prompts are resettable by pressing the system reset button inside the system control panel 12.

The watchman pumping and control system 10 will display on the LCD screen inside the system control panel 12 operational text. Based on the measured flow rate of the pump at the installation, a calculated value of total gallons of water made up to one million gallons will be displayed as a default on the LCD screen. This total value is not resettable by an operator. Once the system has totaled one million gallons of water produced the value will change back to zero and start counting up to one million gallons again, repeating this cycle throughout the systems' life. A second water production value will be displayed on the LCD screen inside of the system control panel 12 as a secondary default screen, displaying total gallons of water pumped since last reset. This is to allow an operator to quantify gallons of water produced between visits to the well site. In one example operation, a counter is reset to zero by pressing the system reset button inside the system control panel 12 for five seconds. After pressing the system reset button for five seconds, the counter value will reset back to zero and will restart totaling gallons of water when the water production process starts again.

Calculations are made based on the water storage vessel 16 capacity of the measured underground deep well pump 22 discharge rate and the float switch 14 or the water pressure switch 25 settings to determine the approximate time required for the deep well pump to fill water storage vessel 16 to a desired or necessary level. The storage vessels 16 are installed on well sites as needed and generally range between 10,000 and 40,000 gallons. Storage reserves also range and depend on livestock loads and pump flows, and can range, for example, from a system that operates nearly every day for 8 hours or more to systems that operate once a week or less. Based on the calculations, a time value plus a selected percent of the calculated time will be inputted into the system control 60 inside on the system control panel 12. When the pump operating time with a confirmed flow at the flow switch 15 exceeds this inputted value, the system control panel 12 of the well watchman pumping and control system 10 indicates that the system has exceeded a reasonable run time, prompting the operator to check for major a leak in the piping system. The system also generally will proceed through a shutdown sequence and will not restart until an operator has pressed the system reset button inside the system control panel 12. This feature is intended to prevent the waste of fuel and preserve ground water.

Figure 3:
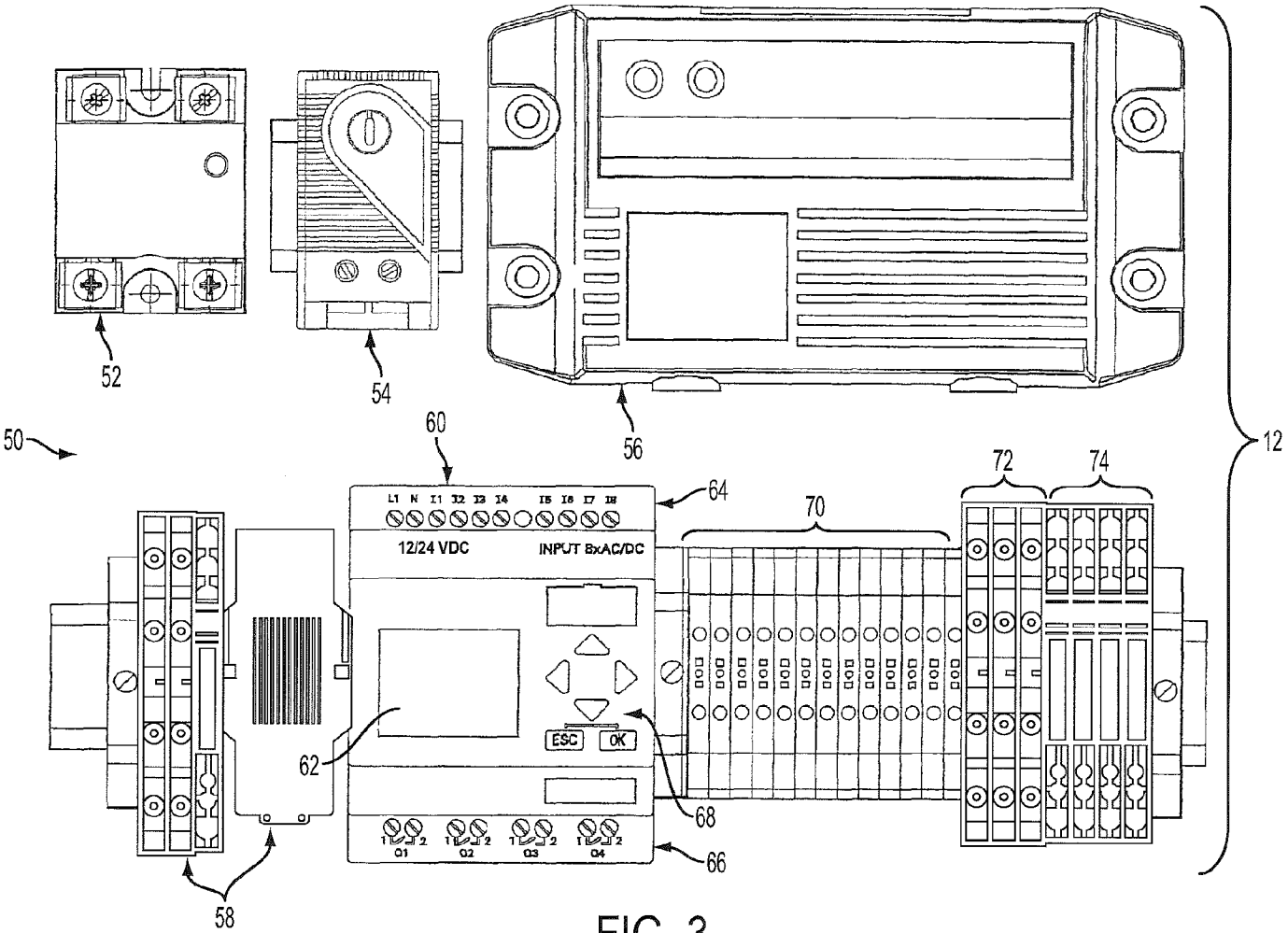
FIG. 3 is a front view of exemplary components in the control panel.

FIG. 3 is a front view of exemplary components in the control panel. FIG. 3 shows components of the interior 50 of control panel 12, including pump relay 52, thermostat 54, battery charger 56, relays 58, controller 60, terminals 70, fuses 72, and relays 74. Controller 60 includes LCD screen 62, inputs 64, outputs 66, and user inputs 68 (such as keyboard, entry keys, etc.). Since additional or fewer components can be included in the interior 50 of control panel 12, the elements shown in FIG. 3 should not be limiting in any manner, and are provide as an exemplary configuration.

Figure 4:
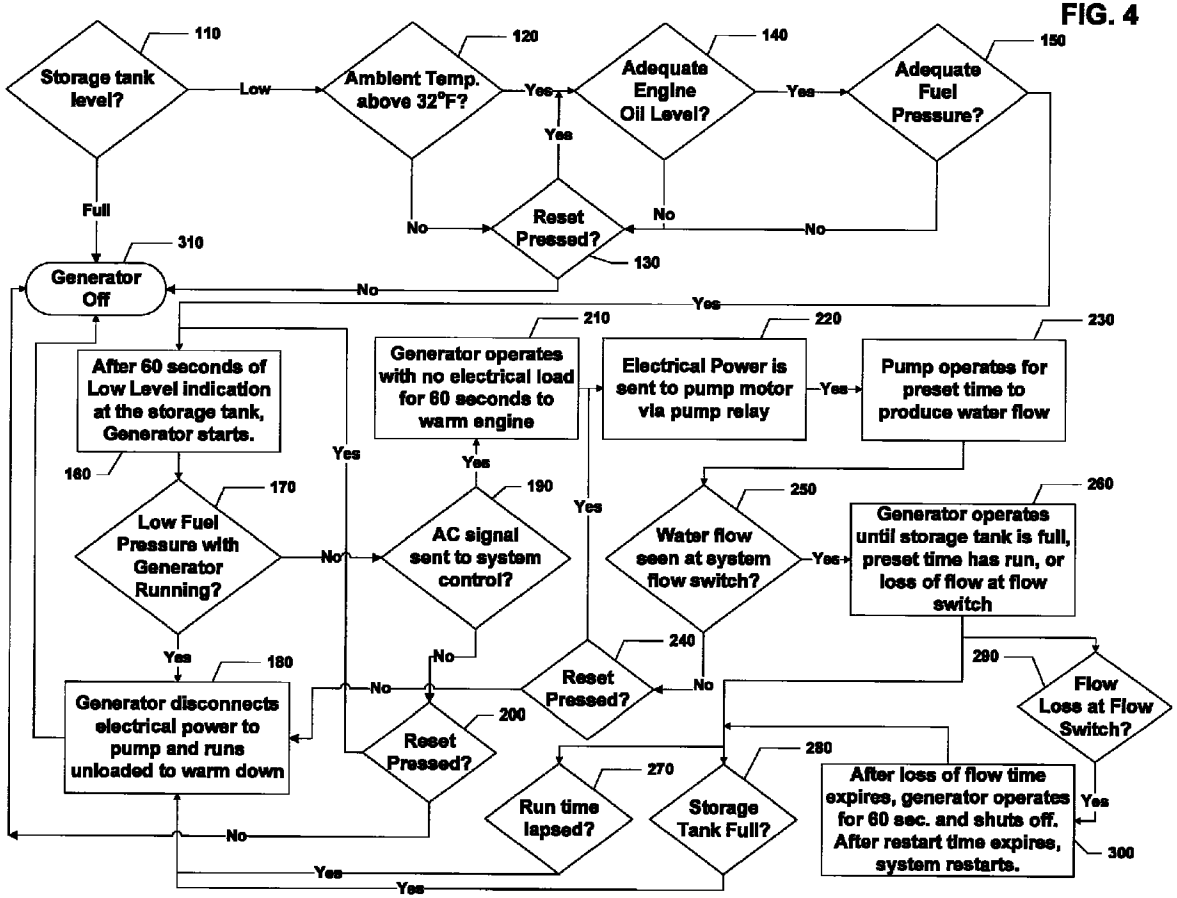
FIG. 4 is a flow chart showing an exemplary sequence of operation of the well watchman pumping and control system.

FIG. 4 is a flow chart showing an exemplary sequence of operation of the well watchman pumping and control system. The exemplary method, indicated at 100, includes a step 110 that analyzes the level of water level in the water storage vessel. If the water level indicates a full level, the generator remains off as shown in step 310. If the water level is indicated at a low level, the method proceeds from step 110 to step 120. At step 120, the ambient temperature surrounding the well watchman system is measured. If the ambient temperature is not above 32, the method returns to step 310 with the generator remaining off. If the ambient temperature surrounding the well watchman system is above 32, the method proceeds from step 120 to step 140. Alternatively, the method can be reset, such as pressing a reset button as shown in step 130. The method then proceeds from step 130 to step 140. At step 140, the method measures the engine oil level. If the engine oil level at step 140 is not okay, the method returns to step 310 and the generator remains off. If the engine oil level is acceptable, the method proceeds from step 140 to step 150. Alternatively, the engine oil level indication can be reset such as indicated at step 130 and the method then proceeds to step 150.

At step 150, the method measures the fuel pressure. If the fuel pressure is not adequate, the method returns to step 310 and the generator remains off. If the fuel pressure is adequate, the method proceeds to step 160. Alternatively, the fuel pressure monitor can be reset such as shown at step 200 and the method can return to step 160.

At step 160, the method measures a time interval that lapses to indicate that a low water level at the water storage vessel is indicated. For example, as indicated at step 160, after sixty continuous seconds have lapsed, the generator will start and produce electric power. The method then will proceed from step 160 to step 170 where fuel pressure will be measured. If the fuel pressure is indicated to be low, the method proceeds from step 170 to step 180 with the generator disconnecting electrical power to the pump and the generator runs for sixty seconds to warm down and then proceeds from step 180 to step 310 to switch the generator off. If at step 170, a low fuel pressure is not indicated, the method proceeds to step 190. At step 190, the AC electricity signal to the system control is monitored for two seconds. If this is indicated, the method proceeds from step 190 to step 210. If it is not indicated, the method proceeds from step 190 to step 310 with the generator switching off. Alternatively, the method can proceed from step 190 and indicate that a reset button has been pressed and the method can return to step 160 to proceed as indicated above.

At step 210, the generator operates with no electrical load for sixty seconds to warm the engine and the method then proceeds to step 220. At step 220, electrical power is sent to the submersible pump motor by way of a system control pump relay and the method proceeds to step 230. Alternatively, the reset button can be pressed as indicated at step 240 and the method then proceeds to step 180 as detailed above.

At step 230, the submersible pump operates for the preset time of about sixty seconds to produce water flow to confirm flow at the flow switch preventing continued operation in a no flow condition, such as a frozen pipe. The method then proceeds from step 230 to step 250 where water flow is monitored at the system flow switch. If water flow is not indicated at the system flow switch, the method proceeds from step 250 to step 180 as indicated above. Alternatively, if water flow is not seen at the system flow switch, the method can be reset as indicated at 240 and return to step 230 as indicated above. If water flow is indicated at the system flow switch, the method proceeds from step 250 to step 260. At step 260, the generator operates and provides electrical power to the submersible pump motor until the storage tank indicates a full level, or until a preset allowed run time is elapsed, or until a loss of flow is indicated at the flow switch.

The method then proceeds from step 260 to either step 270, 280 or 290. If the allowed run time has elapsed, the method proceeds from step 260 to step 270. If the water storage tank indicates a full level, the method proceeds from step 260 to step 280. If step 260 indicates a loss of flow at the flow switch, the method proceeds from step 260 to step 290. If the allowed run time has elapsed at step 270, the method proceeds to step 180 as indicated above and then proceeds to switch off the generator at step 310. If at step 280 the water storage tank as full, the method proceeds to step 180 as indicated above and then proceeds to step 310 to switch the generator off. If a loss of flow at a flow switch is indicated at step 290, the method proceeds to step 300. At step 300, after the preset loss of flow time expires, the generator will operate for sixty seconds and shut off. Then, after a preset restart time has expired, the pumping process will be restarted and operated until the water storage tank indicates a full level. After step 300, the method proceeds from step 300 to step 280 to indicate that the water storage tank is full and then proceeds from step 280 to step 180 as detailed above and eventually to step 310 to switch the generator off.

The present well watchman pumping and control system 10 addresses several shortcomings realized in prior systems, including providing the ability to operate in both daylight and night hours along with significantly greater flow rates, giving the well watchman pumping and control system 10 water production capabilities that exceed those of wells supported by solar powered water production systems, and potentially allowing the user of the well watchman pumping and control system 10 opportunities for greater livestock grazing and production capabilities where water is currently the limiting factor.

Operating the well watchman pumping and control system 10 in place of a windmill water production system will produce greater flow rates than windmill powered water production systems and will prevent the waste of ground water which is pumped from the ground to a water storage vessel, since windmills have no level control capabilities, and once the storage vessel is full, excess water typically is then allowed to spill out onto the ground, much of which evaporates into the air wasting the precious resource. The maintenance of windmill water production systems also can be very expensive and dangerous to the operator and technicians. Typical frequent maintenance tasks are replacement of the seals at the bottom of the well piping requiring the expense of several man hours and the use of a crane type vehicle. Servicing the gear box assembly at the top of the windmill pumping system tower requires a technician to climb high up to the top of the windmill tower or be raised to the area by some lifting device so that lubrication, oil change maintenance and repairs to that portion can be performed. This exposes a technician to the hazards of working in conditions at heights with tools, lubricants, and being subject to wind gusts that can create an extremely dangerous environment. By the use of the well watchman pumping and control system 10 in place of windmill water production system, the operator will see a reduction in maintenance costs and the substantial elimination of the hazards of working at heights to the technicians conceivably preventing injury and even death involved in accidents associated with working at the heights on windmill towers along with the conditions involved with said activities.

The use of the well watchman pumping and control system 10 in place of a non-intelligent electrical generator also can provide many additional advantages. A full command of the water production operation will be taken by the well watchman pumping and control system 10. While reductions in labor and operating costs due to frequent trips to the well site to refuel to start the generator were the primary focus of the invention, a substantial realized benefit to the operator is that the well watchman pumping and control system 10 will monitor critical system dynamic conditions. Controlling the system operations to operate with respect to these conditions, will result in safe operation to both the electric generator 11 and the underground deep well pump 22 and will prevent both electric generator 11 and underground deep well pump 22 from operating in out of electrical design tolerance conditions such as over voltage, under voltage, generator, low frequency, or the frequency of the generator shutting down under an electrical load (pump motor electrically connected).

Thus it will be appreciated by those skilled in the art that the present invention is not restricted to the particular preferred embodiments described with reference to the drawings, and that variations may be made therein without departing from the scope of the present invention as defined in the appended claims and equivalents thereof.

What is claimed is:

1. A water well pumping and control system comprising:

an electricity generator;

a system control;

a water storage vessel;

a well pump that provides water to the water storage vessel;

at least one water level monitoring device for monitoring a water level in the water storage vessel and a flow rate monitor for the pump; and an ambient temperature monitoring device for monitoring ambient temperature, the generator being operable by the system only when the monitored ambient temperature is above a preset low ambient temperature;

wherein the at least one water level monitoring device relays the water level in the water storage vessel to the system control, which starts the generator and the well pump when the water level reaches a preset low level;

wherein the system control automatically monitors one or more operating conditions of the generator and the well pump to protect against operation under low flow conditions or operation of the generator or pump during unsuitable operating parameters; and wherein, upon an occurrence of the system shutting down, the system is configured to provide a troubleshooting message indicating one or more reasons for shutdown.

2. The system of claim 1 wherein the at least one water level monitoring device is a float switch or a water pressure switch.

3. The system of claim 1 further comprising means for monitoring pump discharge flow.

4. The system of claim 1 further including at least one of (1) means for monitoring a fuel level and means for displaying a low fuel message, (2) means for monitoring an oil level and means for displaying a low oil message, (3) means for displaying a low ambient temperature message, (4) means for monitoring a typical fill time of the storage vessel by monitoring the water flow rate from the pump, the quantity of water required to raise the water level to the high level, or the time lapsed between start and stop of the pump, and (5) means for monitoring electrical output from the generator.

5. The system of claim 4 wherein the system control ceases operation of the pump and generator at an occurrence of at least one of the following: (1) after the fuel level reaches a preset low fuel level, (2) after the oil level reaches a preset low oil level, (3) after the ambient temperature reaches the preset low ambient temperature, (4) after the typical fill time has lapsed without the water level monitoring device indicating the water level in the water vessel has reached the high level, and (5) after an indication that the electrical output from the generator is outside a preset electrical output range.

6. The system of claim 5 wherein the system control relays an error message at the occurrence of at least one of the following: (1) after the fuel level reaches a preset low fuel level, indicating the generator requires fuel, (2) after the oil level reaches a preset low oil level, indicating the generator requires oil (3) after the ambient temperature reaches the preset low ambient temperature, indicating the generator and pump should not be run (4) after the typical fill time has lapsed without the water level monitoring device indicating the water level in the water vessel has reached the high level, indicating a leak in the water storage vessel, and (5) after an indication that the electrical output from the generator is outside a preset electrical output range, indicating an electrical error.

7. The system of claim 4 wherein the system control relays an error message at the occurrence of at least one of the following: (1) after the fuel level reaches a preset low fuel level, indicating the generator requires fuel, (2) after the oil level reaches a preset low oil level, indicating the generator requires oil (3) after the ambient temperature reaches the preset low ambient temperature, indicating the generator and pump should not be run (4) after the typical fill time has lapsed without the water level monitoring device indicating the water level in the water vessel has reached the high level, indicating a leak in the water storage vessel, and (5) after an indication that the electrical output from the generator is outside a preset electrical output range, indicating an electrical error.

8. The system of claim 1 wherein the system control is capable of storing and transmitting at least one operating condition for display at the system, to at least one remote location, or both.

9. The system of claim 8 wherein the operating condition includes one or more of the following: water production data, run time of the generator or pump, lapsed time between operation of the generator or pump, aggregate amount of water pumped, and maintenance time to clean an air filter, oil, or spark plug of the generator.

10. The system of claim 8 wherein the operating condition is displayed on an LCD screen at the system.

11. The system of claim 1 wherein the device for monitoring ambient temperature is automatically operated.

12. A method of autonomously operating a water well pumping and control system, the method comprising:

monitoring ambient temperature;

operating an electricity generator, which is controlled by a system control, the generator operating only when the monitored ambient temperature is above a preset low ambient temperature operating a well pump that provides water to a water storage vessel;

operating a water level monitoring device for monitoring a water level in the water storage vessel;

monitoring the water level in the water storage vessel with the water level monitoring device; and signaling the control system to initiate operation of the generator and well pump when the water level reaches a preset low level.

13. The method of claim 11 wherein the step of monitoring the water level includes the system control receiving a signal from a float switch to commence a system starting sequence.

14. The method of claim 13 wherein the system control initiates operation of the generator and the pump to pump water to fill the water storage vessel to a preset high level and then initiates a shutdown sequence of the generator and pump.

15. The method of claim 14 wherein, if during operation of the pump, the water flow is less than a preset flow rate, the method further comprises:

stopping operation of the pump and generator by the system control.

16. The method of claim 15 wherein the method further comprises:

relaying an error condition.

17. The method of claim 16 wherein the method further comprises:

restarting the system after a preset time has elapsed.

18. The method of claim 15 wherein the method further comprises:

restarting the system after a preset time has elapsed.

19. The method of claim 12 further including at least one of the following: (1) monitoring a fuel level and displaying a low fuel message, (2) monitoring an oil level and displaying a low oil message, (3) displaying a low ambient temperature message, (4) monitoring a typical fill time of the storage vessel by monitoring the water flow rate from the pump, the quantity of water required to raise the water level to the high level, or the time lapsed between start and stop of the pump, and (5) monitoring electrical output from the generator.

20. The method of claim 19 wherein the system control ceases operation of the pump and generator at an occurrence of at least one of the following: (1) after the fuel level reaches a preset low fuel level, (2) after the oil level reaches a preset oil low level, (3) after the ambient temperature reaches the preset low ambient temperature, (4) after the typical fill time has lapsed without the water level monitoring device indicating the water level in the water vessel has reached the high level, and (5) after an indication that the electrical output from the generator is outside a preset electrical output range.

21. The method of claim 19 wherein the system control relays an error message at the occurrence of at least one of the following: (1) after the fuel level reaches a preset low fuel level, indicating the generator requires fuel, (2) after the oil level reaches a preset oil low level, indicating the generator requires oil, (3) after the ambient temperature reaches the preset low ambient temperature, indicating the generator and pump should not be run, (4) after the typical fill time has lapsed without the water level monitoring device indicating the water level in the water vessel has reached the high level, indicating a leak in the water storage vessel, and (5) after an indication that the electrical output from the generator is outside a preset electrical output range, indicating an electrical error.

22. A water well pumping and control system comprising:

an electricity generator;

a system control;

a water storage vessel;

a well pump that provides water to the water storage vessel;

a water level monitoring device for monitoring a water level in the water storage vessel; a flow rate monitor for the pump; and an ambient temperature monitor, the generator being operable by the system only when the monitored ambient temperature is above a preset low ambient temperature;

wherein the water level monitoring device relays the water level in the water storage vessel to the system control, which starts the generator and the well pump when the water level reaches a preset low level;

wherein the system control automatically monitors one or more operating conditions of the generator and the well pump to protect against operation under low flow conditions or operation of the generator or pump during unsuitable operating parameters; and wherein, upon an occurrence of the system shutting down, the system is configured to provide a troubleshooting message indicating one or more any reasons for shutdown.

* * * * *